US011598528B2

(12) United States Patent
Erisgen

(10) Patent No.: US 11,598,528 B2
(45) Date of Patent: Mar. 7, 2023

(54) MULTI-DIMENSIONAL CERAMIC BURNER SURFACE

(71) Applicant: Pinnacle Climate Technologies, Eden Prairie, MN (US)

(72) Inventor: Sukru Erisgen, Eden Prairie, MN (US)

(73) Assignee: Pinnacle Climate Technologies, Eden Prairie, MN (US)

( * ) Notice: Subject to any disclaimer, the term of this patent is extended or adjusted under 35 U.S.C. 154(b) by 30 days.

(21) Appl. No.: 17/028,138

(22) Filed: Sep. 22, 2020

(65) Prior Publication Data

US 2021/0116129 A1 Apr. 22, 2021

Related U.S. Application Data

(60) Provisional application No. 63/057,629, filed on Jul. 28, 2020, provisional application No. 62/916,565, filed on Oct. 17, 2019.

(51) Int. Cl.

| | |
|---|---|
| ***F24C 3/04*** | (2021.01) |
| ***F23D 23/00*** | (2006.01) |
| ***F23D 14/16*** | (2006.01) |

(52) U.S. Cl.

CPC ..... *F24C 3/042* (2013.01); *F23D 14/16* (2013.01); *F23D 23/00* (2013.01)

(58) Field of Classification Search

CPC ..... F23D 14/16; F23D 23/00; F24C 3/042
USPC ..... 431/326–329
See application file for complete search history.

(56) References Cited

U.S. PATENT DOCUMENTS

| | | | | |
|---|---|---|---|---|
| D145,913 | S | 11/1946 | Swartzbaugh | |
| 3,510,239 | A * | 5/1970 | Partiot | F24C 3/042 431/328 |
| 3,635,651 | A * | 1/1972 | Desty | F23D 3/08 431/328 |
| 3,928,961 | A * | 12/1975 | Pfefferle | B01J 35/04 60/737 |
| 4,439,136 | A * | 3/1984 | Pfefferle | F02M 27/02 126/91 A |
| 4,624,241 | A * | 11/1986 | Cherryholmes | F24C 3/14 126/92 B |

(Continued)

FOREIGN PATENT DOCUMENTS

| | | |
|---|---|---|
| CA | 2 650 400 C | 4/2011 |
| CA | 2 541 122 C | 1/2012 |

(Continued)

OTHER PUBLICATIONS

Dyna-Glo User Manual and Operating Instructions, 20 pages (2015).

(Continued)

*Primary Examiner* — Vivek K Shirsat
(74) *Attorney, Agent, or Firm* — Merchant & Gould P.C.

(57) ABSTRACT

A plaque for a radiant heating system can include a main body defining an outer surface and a plurality of pores defined within the main body, wherein at least some of the plurality of pores are disposed in a non-parallel relationship with at least some others of the plurality of pores, or wherein at least some of the pores are parallel with each other. A burner assembly including a plurality of adjacently arranged plaques reduces the ignition time and delay for adjacent plaques after the central plaque has been ignited.

7 Claims, 14 Drawing Sheets

(56) References Cited

U.S. PATENT DOCUMENTS

| | | | | |
|---|---|---|---|---|
| 4,673,349 | A * | 6/1987 | Abe | F23D 14/12 431/170 |
| 6,340,298 | B1 | 1/2002 | Vandrak et al. | |
| 6,446,623 | B1 | 9/2002 | Resmo et al. | |
| 6,648,635 | B2 | 11/2003 | Vandrak et al. | |
| 6,742,814 | B2 | 6/2004 | Resmo et al. | |
| 6,843,244 | B2 | 1/2005 | McCalley et al. | |
| 6,884,065 | B2 | 4/2005 | Vandrak et al. | |
| 7,300,278 | B2 | 11/2007 | Vandrak et al. | |
| 8,053,709 | B2 | 11/2011 | Vandrak et al. | |
| 8,068,724 | B2 | 11/2011 | Vandrak et al. | |
| D660,946 | S | 5/2012 | Sengoku et al. | |
| 8,347,875 | B2 | 1/2013 | Jamieson | |
| 8,434,469 | B2 | 5/2013 | Vandrak | |
| 8,487,221 | B2 | 7/2013 | Vandrak et al. | |
| 8,490,639 | B2 | 7/2013 | Vandrak | |
| 8,494,350 | B2 | 7/2013 | O'Toole et al. | |
| 8,863,736 | B2 | 10/2014 | Vandrak | |
| 8,893,706 | B2 | 11/2014 | Vandrak et al. | |
| 8,893,707 | B2 | 11/2014 | Jamieson | |
| 9,267,708 | B2 | 2/2016 | Jamieson | |
| 9,927,144 | B2 | 3/2018 | Vandrak et al. | |
| 10,036,571 | B1 | 7/2018 | Gove et al. | |
| D864,365 | S | 10/2019 | Downing et al. | |
| 10,495,344 | B2 | 12/2019 | Vandrak et al. | |
| 10,544,871 | B2 | 1/2020 | Vandrak et al. | |
| D907,753 | S | 1/2021 | Tschopp | |
| 2008/0152329 | A1 | 6/2008 | Saunders et al. | |
| 2010/0139651 | A1 | 6/2010 | Vandrak | |
| 2010/0147291 | A1 | 6/2010 | Vandrak | |
| 2011/0045417 | A1 | 2/2011 | Vandrak | |
| 2012/0094244 | A1 | 4/2012 | Vandrak | |
| 2016/0040905 | A1 * | 2/2016 | Shellenberger | F24H 9/1881 126/116 R |
| 2017/0254544 | A1 | 9/2017 | Beerens et al. | |
| 2017/0363326 | A1 | 12/2017 | Vandrak et al. | |
| 2017/0363327 | A1 | 12/2017 | Vandrak et al. | |
| 2019/0041093 | A1 | 2/2019 | Vandrak et al. | |
| 2019/0170349 | A1 | 6/2019 | Martin | |
| 2020/0072500 | A1 | 3/2020 | Vandrak et al. | |
| 2020/0149645 | A1 | 5/2020 | Vandrak et al. | |

FOREIGN PATENT DOCUMENTS

| | | | |
|---|---|---|---|
| CA | 2 759 762 | C | 6/2013 |
| CA | 2 759 775 | C | 9/2013 |
| CA | 2 759 864 | C | 10/2013 |
| CA | 2 759 969 | C | 12/2013 |
| CA | 2 713 971 | C | 12/2014 |
| CA | 2 759 926 | C | 12/2014 |
| CA | 3 040 273 | A1 | 4/2018 |
| CA | 2 988 129 | A1 | 12/2018 |
| CN | 100549551 | C | 10/2009 |
| CN | 101517319 | B | 12/2013 |
| CN | 106337956 | A | 1/2017 |
| CN | 209147210 | U | 7/2019 |
| KR | 20-1995-0010234 | Y1 | 11/1995 |
| KR | 10-2013-0039243 | A | 4/2013 |
| KR | 10-1436280 | B1 | 8/2014 |
| WO | 2013/188909 | A1 | 12/2013 |

OTHER PUBLICATIONS

Mr. Heater 2018 Master Catalog, https://assets.unilogcorp.com/187/ITEM/DOC/100001967_Catalog.pdf, 68 pages, Enerco Group Inc. (2018).

International Search Report and Written Opinion for Application No. PCT/US2021/043296 dated Nov. 8, 2021.

* cited by examiner

PRIOR ART

MULTI-DIMENSIONAL CERAMIC BURNER SURFACE

CROSS-REFERENCE TO A RELATED APPLICATION

This application includes the disclosures of U.S. Provisional Application Ser. No. 62/916,565, filed Oct. 17, 2019 and U.S. Provisional Application Ser. No. 63/057,629, filed Jul. 28, 2020. The complete disclosures of U.S. Application Ser. Nos. 62/916,565 and 63/057,629 are incorporated herein by reference. A claim of priority is made to U.S. Provisional Application Ser. Nos. 62/916,565 and 63/057,629, to the extent appropriate.

BACKGROUND

Portable and stationary natural or propane gas fired infrared heaters commonly use plaques. A typical plaque size ranges from 4 square inches to 40 square inches or larger. They can be square, rectangular, round or irregular shape. Each plaque has a flat surface and comes with number of very small holes (pores) in a pattern, each hole measuring around 1 mm in diameter or less. These holes are perpendicular to front and rear surfaces and placed in a geometrical (honeycomb) pattern. For example, see the prior art plaque shown in FIG. 1 and the burner assembly 12 shown at FIG. 2 incorporating two plaques. The gas burner plaque can be used in a variety of industries including commercial and residential heating, food cooking and industrial process heating. It is also very common in portable heating applications.

SUMMARY

A plaque for a radiant heating system can include a main body defining an outer surface and a plurality of pores defined within the main body, wherein at least some of the plurality of pores are disposed in a non-parallel relationship with at least some others of the plurality of pores.

In some examples, the main body outer surface is planar.

In some examples, the outer surface is curved in a first direction.

In some examples, the outer surface is curved in more than one direction.

In some examples, the outer surface is curved in a first direction and curved in a second direction orthogonal to the first direction.

In some examples, each of the plurality of pores is disposed generally orthogonally to the outer surface.

A burner assembly can include a plurality of plaques arranged in an array, each including a main body defining an outer surface and a plurality of pores defined within the main body, wherein at least some of the plurality of pores are disposed in a non-parallel relationship with at least some others of the plurality of pores, wherein outer pores of adjacent plaques form a non-zero approach angle with respect to each other.

In some examples, the main body outer surface of each of the plaques is planar.

In some examples, the outer surface of each of the plaques is curved in a first direction.

In some examples, the outer surface of each of the plaques is curved in more than one direction.

In some examples, the outer surface of each of the plaques is curved in a first direction and curved in a second direction orthogonal to the first direction.

In some examples, each of the plurality of pores of each of the plaques is disposed generally orthogonally to the outer surface.

A portable heater can include a housing having a handle, a fuel source supported by the housing, and a burner assembly in fluid communication with the fuel source and located within the housing. The burner assembly can include one or more plaques including a main body defining an outer surface and a plurality of pores defined within the main body, wherein at least some of the plurality of pores are disposed in a non-parallel relationship with at least some others of the plurality of pores.

In some examples, the fuel source is a portable propane tank.

In some examples, the outer surface is curved in a first direction.

In some examples, the outer surface is curved in more than one direction.

In some examples, the outer surface is curved in a first direction and curved in a second direction orthogonal to the first direction.

In some examples, each of the plurality of pores is disposed generally orthogonally to the outer surface.

A plaque for a radiant heating system can include a main body defining a curved outer surface, the main body having a longitudinal axis, and a plurality of pores defined within the main body, wherein at least some of the plurality of pores are disposed in a non-orthogonal relationship with the outer surface.

In some examples, the outer surface is curved in a first direction between sides of the main body.

In some examples, the pores have a diameter of about 1.2 millimeters.

In some examples, the plurality of pores are oriented such that all of the pores are parallel to each other.

In some examples, at least some of the pores are parallel to the longitudinal axis.

A heating element for a radiant heating system can include a main body defining an inner surface and a curved outer surface, the main body having a longitudinal axis, and a plurality of pores extending through the main body between the inner surface and the outer surface.

In some examples, the entire outer surface is curved.

In some examples, the outer surface is curved along a constant radius.

In some examples, the inner surface is curved.

In some examples, the outer surface is symmetrical about a longitudinal axis.

In some examples, the outer surface is curved between a first side and a second side.

In some examples, the outer surface is curved in one direction.

In some examples, the outer surface is curved in two directions.

In some examples, at least some of the plurality of pores are disposed in a non-orthogonal relationship with the outer surface.

In some examples, some of the plurality of pores are disposed in a non-parallel relationship with at least some others of the plurality of pores.

A heater can include a housing, a burner located within the housing, and a plaque or heating element, having any of the aforementioned features, located within the housing proximate the burner. In some examples, the heater can be portable and provided with a handle.

A heater, such as a portable heater, can include a housing, a burner located within the housing, a plaque located within the housing proximate the burner, the plaque including: a main body defining a curved outer surface, the main body having a longitudinal axis and plurality of pores defined within the main body.

In some examples, at least some of the plurality of pores are disposed in a non-orthogonal relationship with the outer surface.

In some examples, some of the plurality of pores are disposed in a non-parallel relationship with at least some others of the plurality of pores.

A variety of additional aspects will be set forth in the description that follows. The aspects can relate to individual features and to combinations of features. It is to be understood that both the forgoing general description and the following detailed description are exemplary and explanatory only and are not restrictive of the broad inventive concepts upon which the examples disclosed herein are based.

BRIEF DESCRIPTION OF THE DRAWINGS

The accompanying drawings, which are incorporated in and constitute a part of the description, illustrate several aspects of the present disclosure. A brief description of the drawings is below.

DETAILED DESCRIPTION

Figure 1:
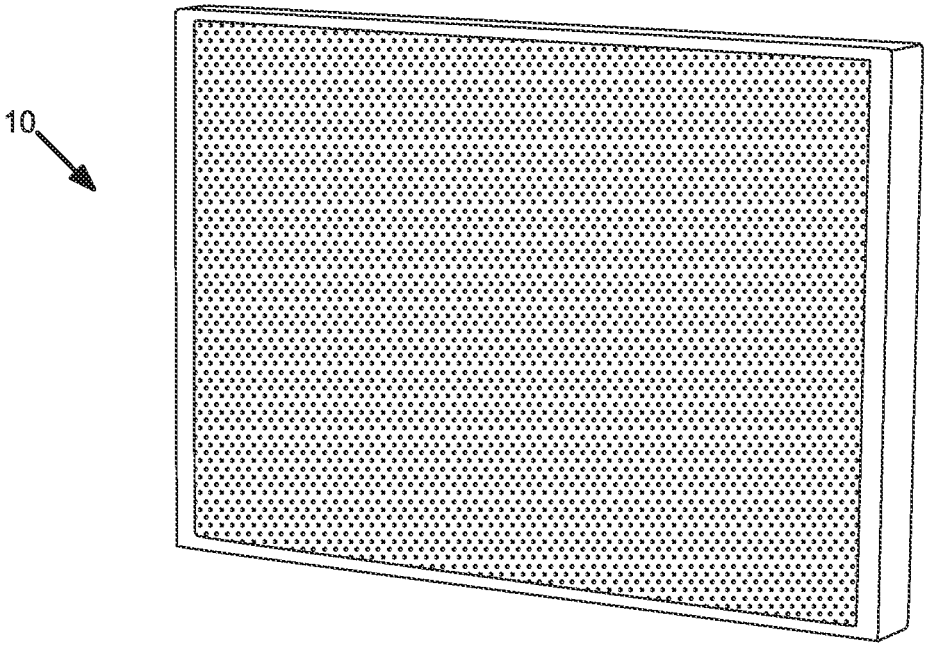
FIG. 1 is a perspective view of a prior art plaque usable in an infrared heater application.

Various examples will be described in detail with reference to the drawings, wherein like reference numerals represent like parts and assemblies throughout the several views. Reference to various examples does not limit the scope of the claims attached hereto. Additionally, any examples set forth in this specification are not intended to be limiting and merely set forth some of the many possible examples for the appended claims. Referring to the drawings wherein like reference numbers correspond to like or similar components throughout the several figures.

Figure 2:
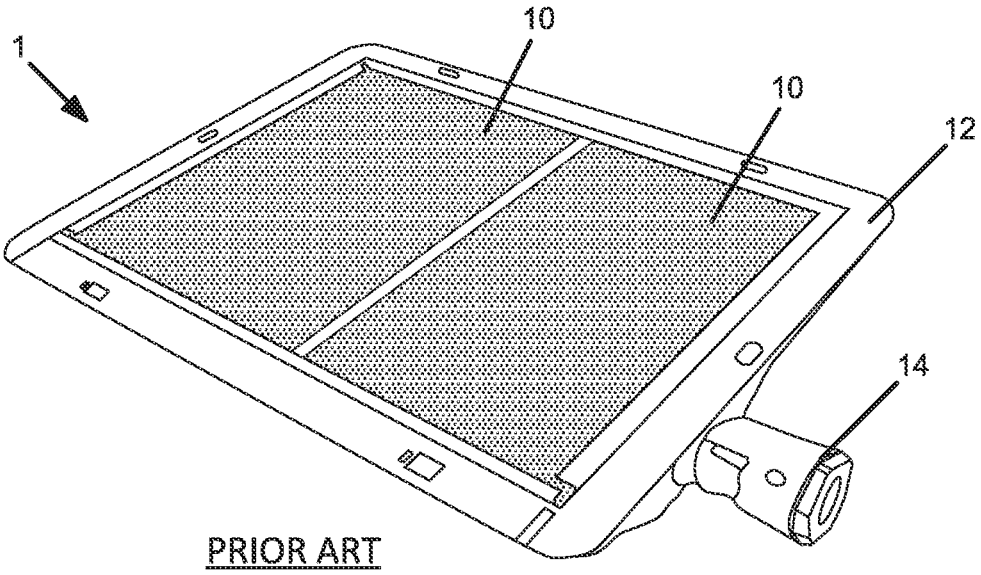
PRIOR ART FIG.2
FIG. 2 is a perspective view of a pair of the prior art plaques shown in FIG. 1 cemented together and installed in a burner housing.

Referring to FIGS. 1 and 2, which show prior art designs, a plaque 10 is usually attached to a metal burner housing 12 with an inlet tube 14 where air and gas are mixed. A plaque 10 may deliver anywhere from 300-400 Btu/Hr per square inches. FIG. 2 shows a single burner assembly 1 with two plaques 10 cemented together. When a single burner 1 is needed to operate, a gas valve opens and allow gas to flow into the inlet tube 14 of the burner housing where it is mixed with air. This mixture flows into burner chamber and flow out through the holes provided through plaque 10. A pilot light (flame) is placed in front of a burner plaque ignite the gas mixture flowing through. Since there are so many small holes through the plaque near invisible flame covers the surface of plaque, plaque start to glow in red and generate infrared and radiation heat. Most of the radiant heat travels perpendicular to the surface, therefor they heat the direction they are pointed towards.

When more heating capacity is needed, multiples of these plaques 10 are lined up next to each other in horizontal direction. In such situation, a pilot light is placed in front of the middle burner. When gas starts to flow into multiples of burners (such as 3 or 5 burners), the middle burner is ignited first while the gas is still flowing into adjacent burners 1. At this point flame direction from the ignited burner(s) 1 and gas flow directions from unignited burner(s) are in (or nearly in) a parallel direction. As the unignited burner(s) dissipates gas, the gas accumulate in front of unignited burner(s). Heat and a small amount of flame from the center burner eventually ignite adjacent burners. This causes a delayed ignition. In most cases, the delayed ignition creates a short-lived fireball in front of the burner assembly. The delayed ignition can be acceptable but is nevertheless visible. This delayed ignition happens faster on a 3 burner system vs. 5 burner system. In larger systems such delay may take 5-10 seconds and creates a contained but very visible burst of flame last few seconds.

There are number of ways to eliminate a delayed ignition on multiple burner plaque type heaters. Once of the solutions is to place a pilot light in front of each burner assembly. Such a system will consume fuel through pilot lights even when the heater is off. Such a solution will also increase equipment cost and create a challenge to control each pilot light. This approach is disadvantageous from multiple aspects.

It is advantageous for each burner in an assembly to be ignited simultaneously with the center burner, but can be difficult without significantly increasing energy consumption and equipment costs. These objectives can be accomplished by configuring the heating elements or plaques such that the heat is transferred to adjacent burners in direct path.

In accordance with the present disclosure, and with reference to FIGS. 3 to 7, a burner section 100 is disclosed including a heating element 110 retained by a housing 102 which is connected to a burner tube 104 housing a burner nozzle 106. As shown, the heating element 110 is configured as a plaque 110 with pores 112 through which gas can flow. The plaque 110 is curved to allow the pores 112 to simultaneously point perpendicular to an exterior surface 110*a* of the plaque 110 to point in a radial direction. In some examples, the plaque 110 is formed from a cordierite (i.e.

magnesium aluminum silicate) ceramic material. Accordingly, the plaque 110 may be referred to as a ceramic plaque. In some examples, pores 112 are first formed in a flat, uncured material, the material is then subsequently curved, and the material is then cured, such as by firing, to form the finished plaque. In some examples, the uncured material is first shaped to define the curved outer surface and the pores are then formed into the material, after which the material is then cured.

Figure 7:
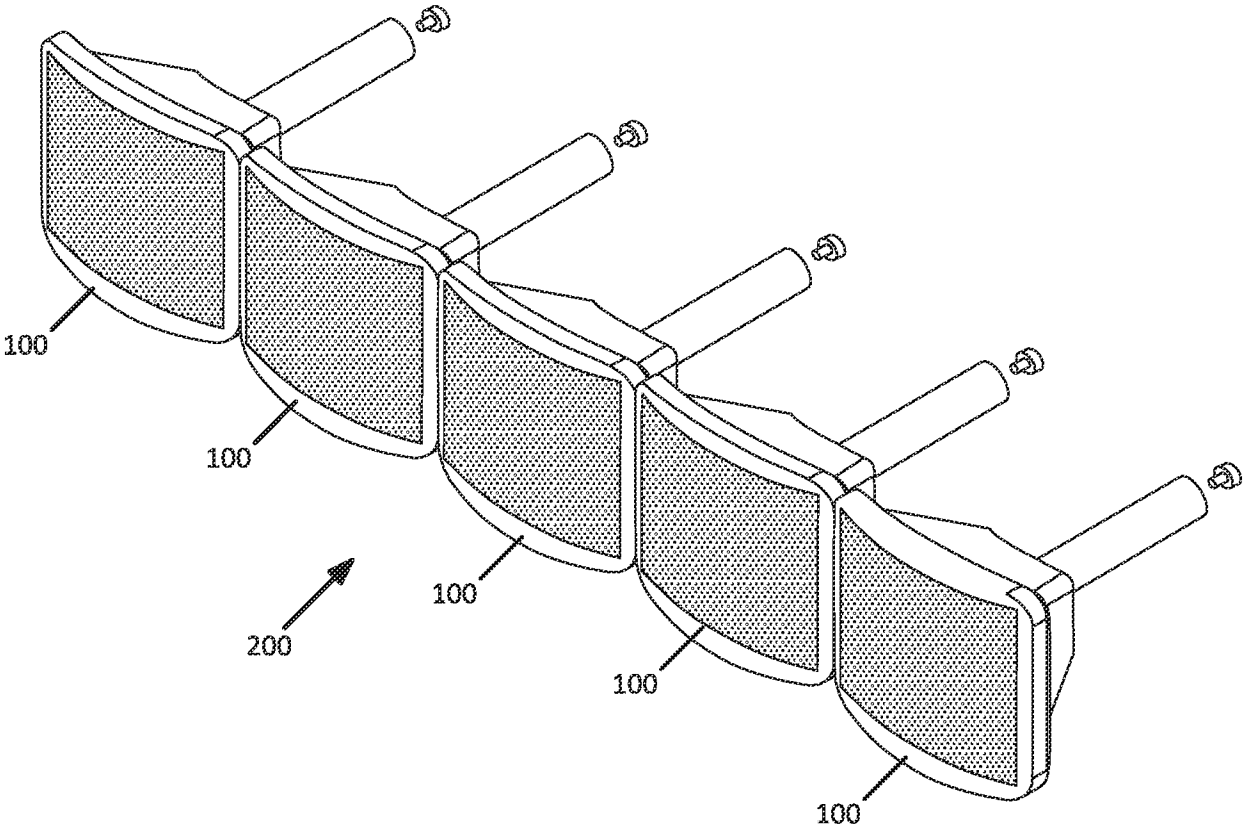
FIG. 7 is a perspective view of a burner assembly including multiples of the burner sections shown in FIG. 3.
Figure 8:
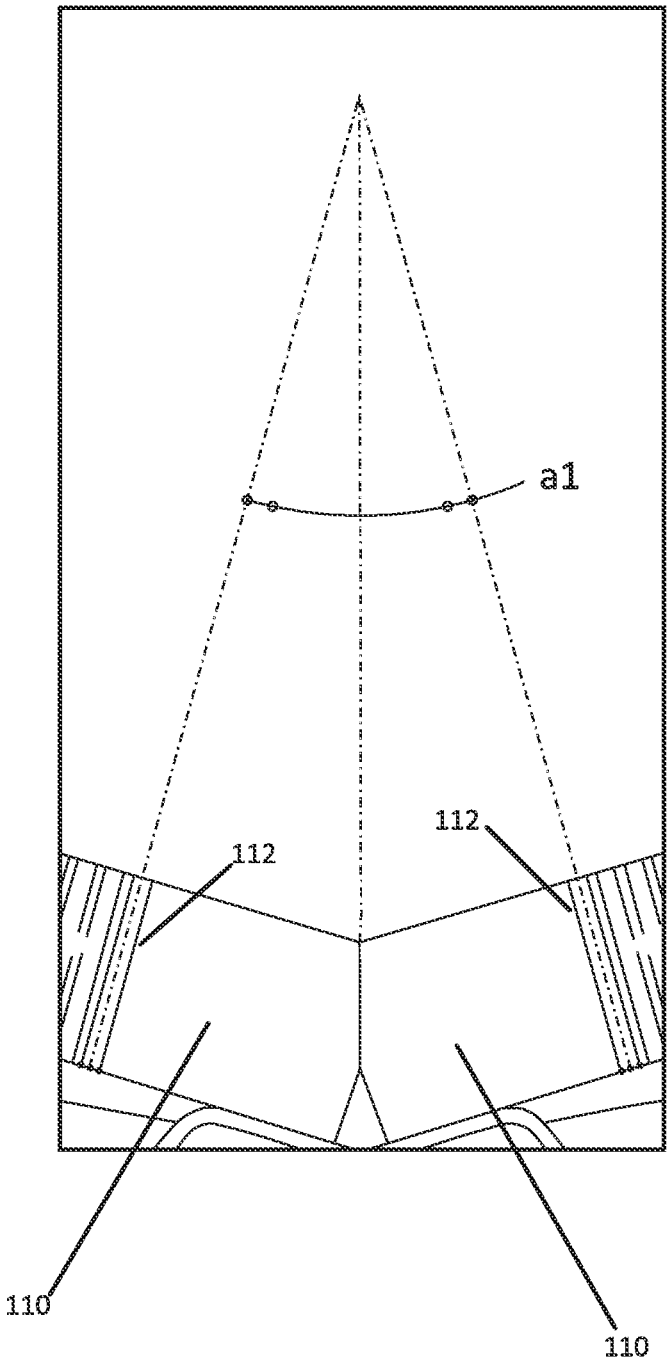
FIG. 8 is a top view of a portion of the burner assembly shown in FIG. 6.

Multiple plaques 110 can be positioned next to each other in a side-by-side arrangement to form a burner assembly 200, as shown at FIG. 7. The flame from one curved plaque 110 is then closer in proximity to gas flow from the adjacent curved plaque 110. Accordingly, where a pilot light is positioned beneath the center plaque 110, the adjacent plaques 100 on each side will quickly ignite which will in turn cause the two outbound plaques 100 to also ignite soon thereafter. With reference to FIG. 8, it can be seen that the pores 112 of the adjacent plaques 110 are not positioned in parallel and are instead angled towards each other such that an angle of approach a1 results. The angle of approach a1 provided by the radius of the curved plaque 110 improves the ignition and reduce the ignition delay. In the example shown, the angle of approach a1, which is the angle between the pores 112 is about 31 degrees. Other non-zero angles are possible. Curving a plaque 110 also helps radiate heat to a larger radius since radiant heat travels mostly perpendicular to the radiating surface.

Figure 9:
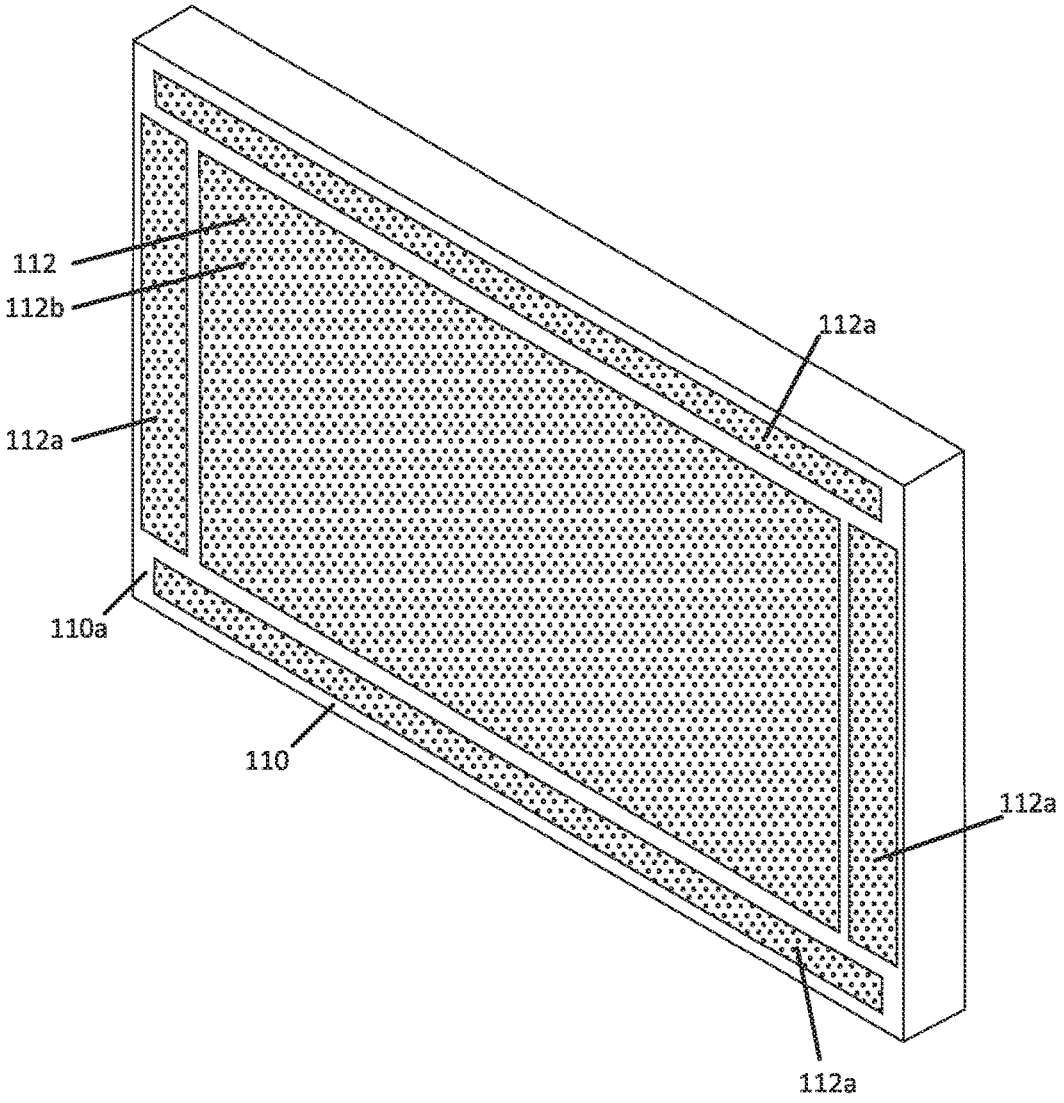
FIG. 9 is a perspective view of an example heating element in accordance with the present disclosure.
Figure 10:
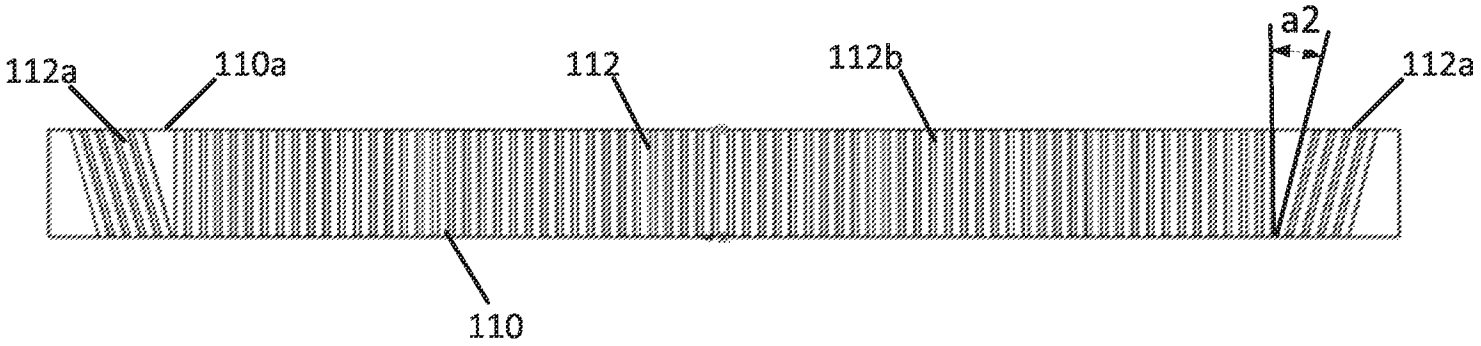
FIG. 10 is a cross-sectional view of the heating element shown in FIG. 9.

With reference to FIGS. 9 and 10, another way to obtain said angle of approach without providing a curved plaque is to provide a flat plaque 110 with multiple rows of pores 112. One or more outer rows of the pores 112*a* of plaque 10 are disposed at an oblique angle a2 to the outer surface of the plaque 110. In such an arrangement, the one or more inner rows of pores 112*b* can be positioned at either an oblique angle or orthogonal to the outer surface 110*a*. In the example shown, five angled outer rows of pores 112*a* are provided on each side of the plaque 110 and four angled outer rows of pores 112*a* or provided on the top and bottom of the plaque 110 with the remaining inner rows of pores 112*b* being orthogonally positioned pores 112. Other arrangements are possible. When plaques 110 of this type are placed adjacent to each other in a single or multiple row array, an angle of approach which equals twice the angle a2 is formed between the adjacent plaques 110. In such an arrangement, the dedicated outer rows of pores 112*a* will guide heat and flame from the first ignited plaque 10 to adjacent plagues, therefor reducing a delayed ignition. In the example shown, the angle a2 is about 15 degrees from perpendicular. However, the angle of outer pores 112 can be selected to control angle of approach, as desired for particular applications.

Figure 11:
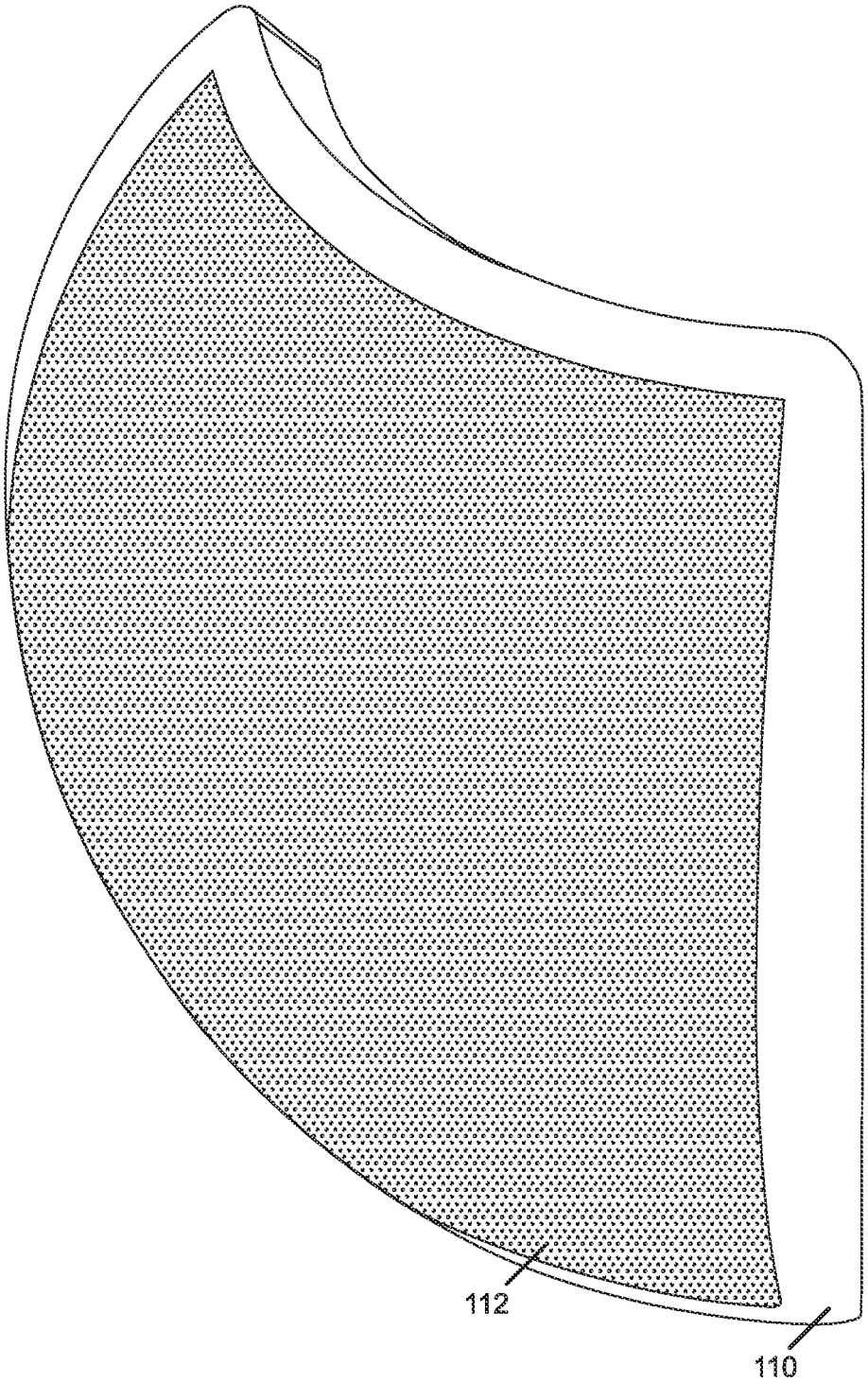
FIG. 11 is a perspective view of an example heating element in accordance with the present disclosure.
Figure 12:
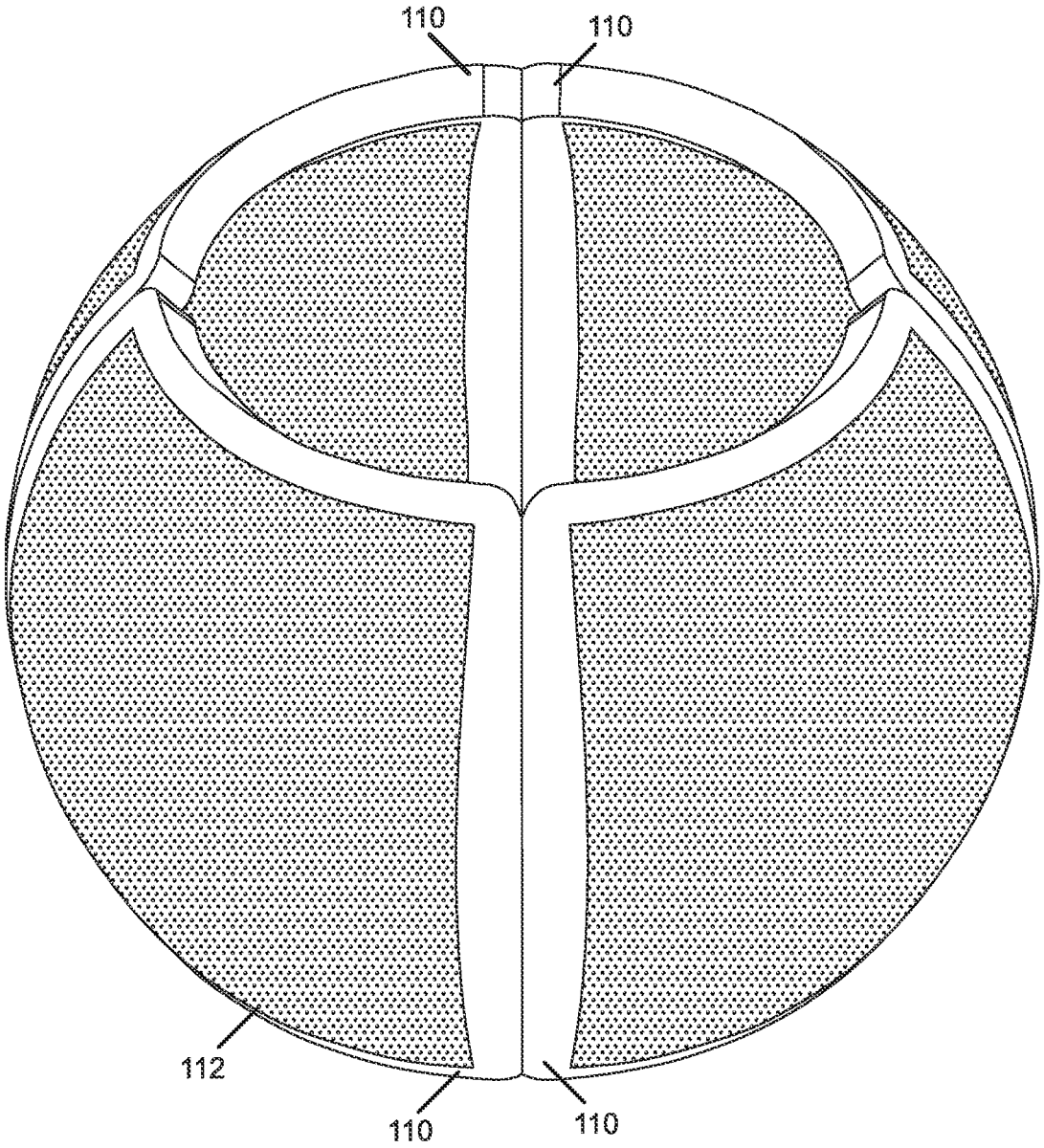
FIG. 12 is a perspective view of multiples of the heating element shown in FIG. 11 arranged to provide a 360 degree heating arrangement.

With reference to FIGS. 10 and 11, it can be seen that the curved plaques 110 can be curved in two directions to create a multi-curved plaque 110, instead of the single direction shown at FIGS. 3 to 7. With such an arrangement, the curved plaques 110 can radiate heat at an even larger overall radius. As shown at FIG. 11, such curved plaques 110 can also be stacked or arranged to create a radial, spherical or semi-spherical radiant heater. In the example shown at FIG. 11, each plaque 10 is curved 90 degrees in one direction such that a sphere can be formed from four individual plaques 110. Other arrangements are possible. In one example, multi-curved plaques 110 are placed next to each other in an arrangement similar to that shown in FIG. 6. Multi-curved plaques 110 can also be arranged in multiple row arrays as a non-zero approach angle between the pores 112 which exist along each side of the plaque 110. Other sizes, shapes, and arrangements of plaques 10 may be provided that create a non-zero approach angle without departing from the concepts presented herein.

Figure 13:
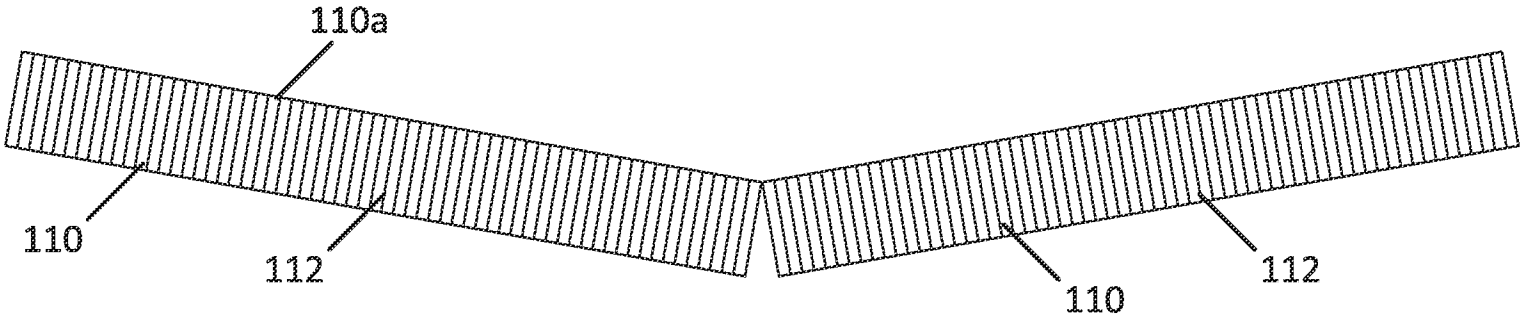
FIG. 13 is a schematic top view of an example heating element arrangement in accordance with the present invention.

With reference to FIG. 13, it can be seen that the non-zero approach angle can be created between two adjacent plaques 110 having pores 112 disposed orthogonal to the outer surface 110*a* by positioning two plaques 110 at an angle to each other to create a concave type of arrangement.

Referring to FIGS. 14 to 17, an example of a curved plaque or heating element 110 is presented in which the outer surface 110*a* is curved in a single direction to have a radius R about a center point C passing through a longitudinal axis X of the heating element 110. As shown, the outer surface 110*a* extends between a top side 110*b*, a bottom side 110*c*, a first side 110*d*, and a second side 110*e*. In one aspect, the curve of the surface 110*a* can be characterized as being a curve formed about a first axis C in a side to side manner (i.e. curved between sides 110*d*, 110*e*). Accordingly, the sides 110*d*, 110*e* are disposed with respect to each other at the same angle. In the example shown, the heating element 110 is curved through an angle between 0 and 90 degrees, and in some examples is curved through an angle between 10 and 60 degrees, and in some examples is curved through an angle between 50 and 60 degrees. In the example shown the heating element 110 is curved through an angle of about 57 degrees.

Although the outer surface 110*a* is curved in only one direction about a single axis, the outer surface 110*a* could be curved about a different axis perpendicular to the first axis such that the outer surface is provided with a top-to-bottom curve (i.e. between top 110*b* and bottom 110*c*) rather than the depicted side-to-side curve. In some examples, the outer surface can be curved in both directions. In contrast to the example shown at FIG. 3, the pores 112 of the heating element 110 at FIGS. 14 to 17 are arranged parallel to each other and with the longitudinal axis X of the heating element 110. Accordingly, the centermost pores 112 are generally orthogonal to the outer surface 110*a* proximate the longitudinal axis and are increasingly oblique to the longitudinal axis proximate the sides 110*d*, 110*e*. Such a configuration is advantageous from the perspective that the pores 112 are more easily manufactured into the heating element 110. In the example shown, the heating element 110 is provided with 4,571 pores 112 at an approximate diameter of 1.2 mm. More or fewer pores at a different diameter may be used. The example shown also includes a diamond radiant surface pattern in the outer surface 110*a*.

Figure 3:
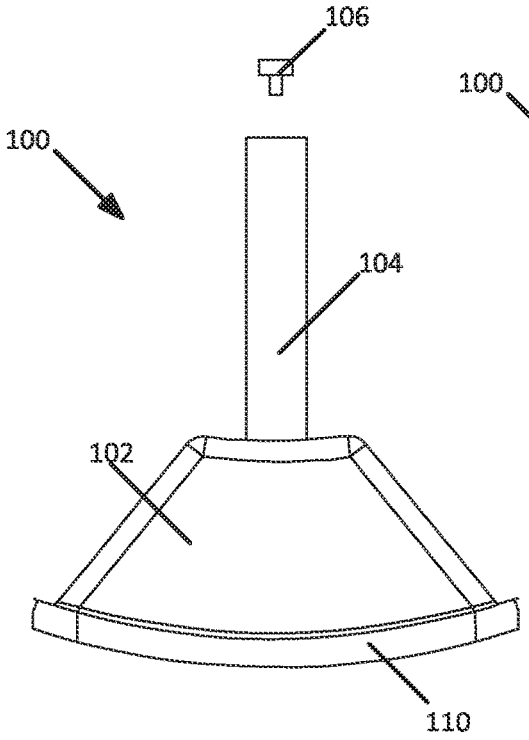
FIG. 3 is a top view of a burner section including a heating element in accordance with the present disclosure.
Figure 4:
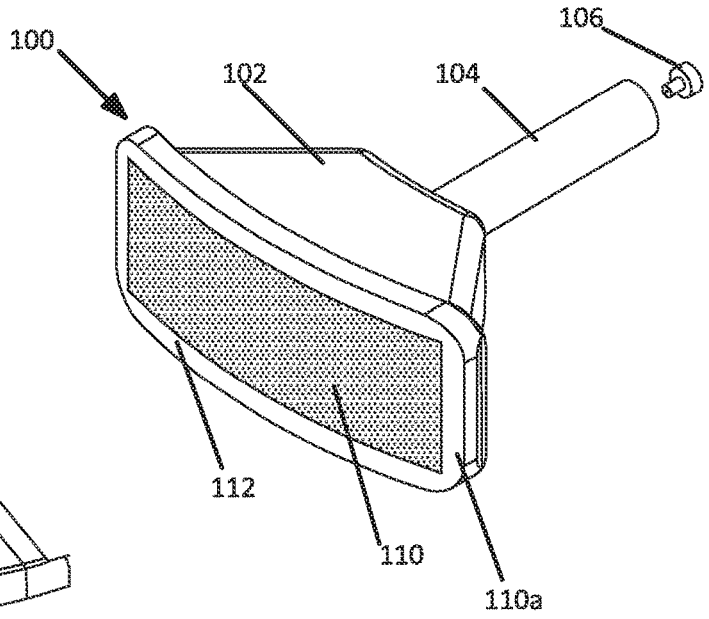
FIG. 4 is a perspective view of the burner section shown in FIG. 3.
Figure 5:
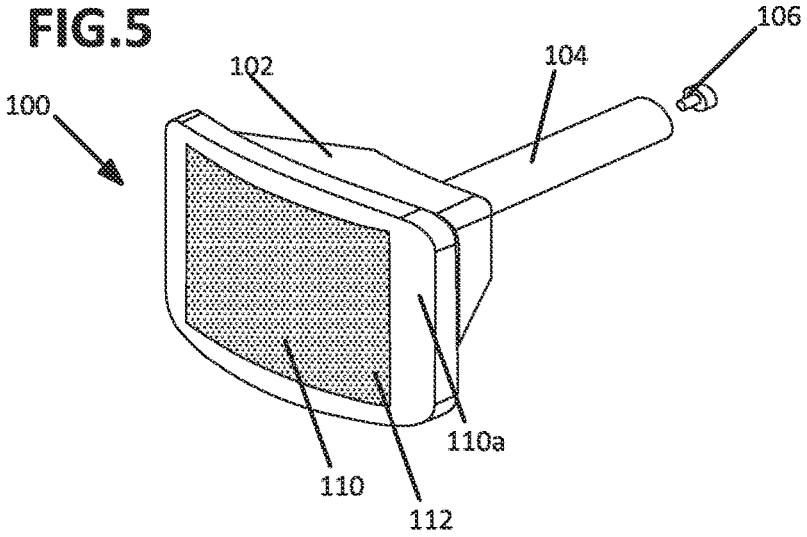
FIG. 5 is a perspective view of the burner section shown in FIG. 3.
Figure 6:
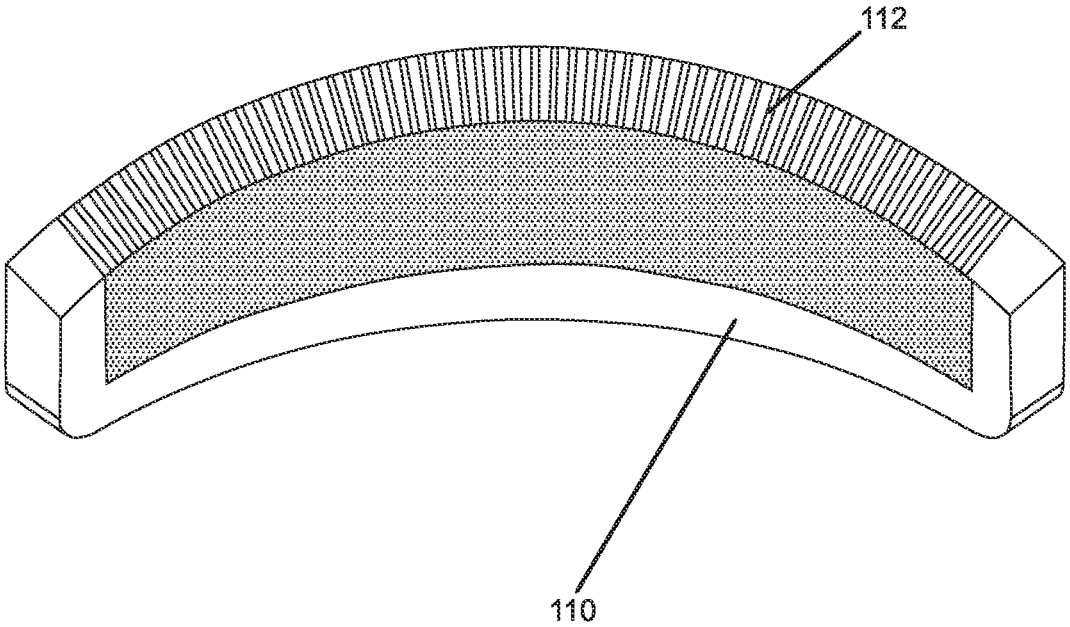
FIG. 6 is a perspective cross-sectional view of the burner section shown in FIG. 3.
Figure 14:
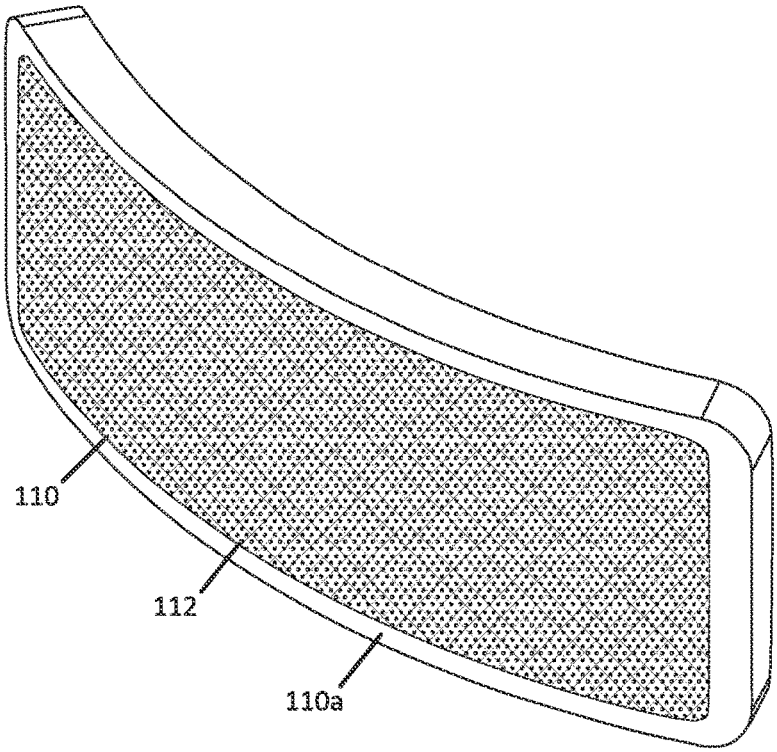
FIG. 14 is a perspective view of an example heating element in accordance with the present disclosure.
Figure 15:
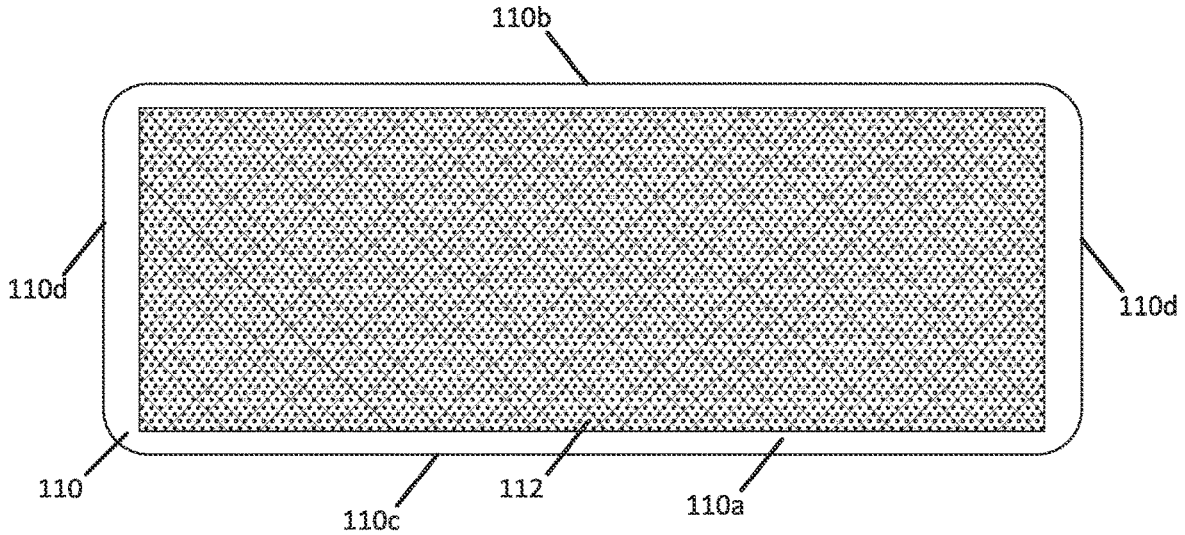
FIG. 15 is a front view of the heating element shown in FIG. 14.
Figure 16:
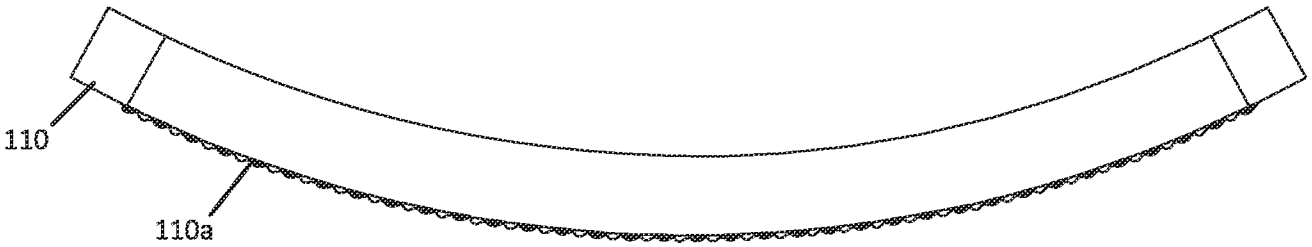
FIG. 16 is a top view of the heating element shown in FIG. 14.
Figure 17:
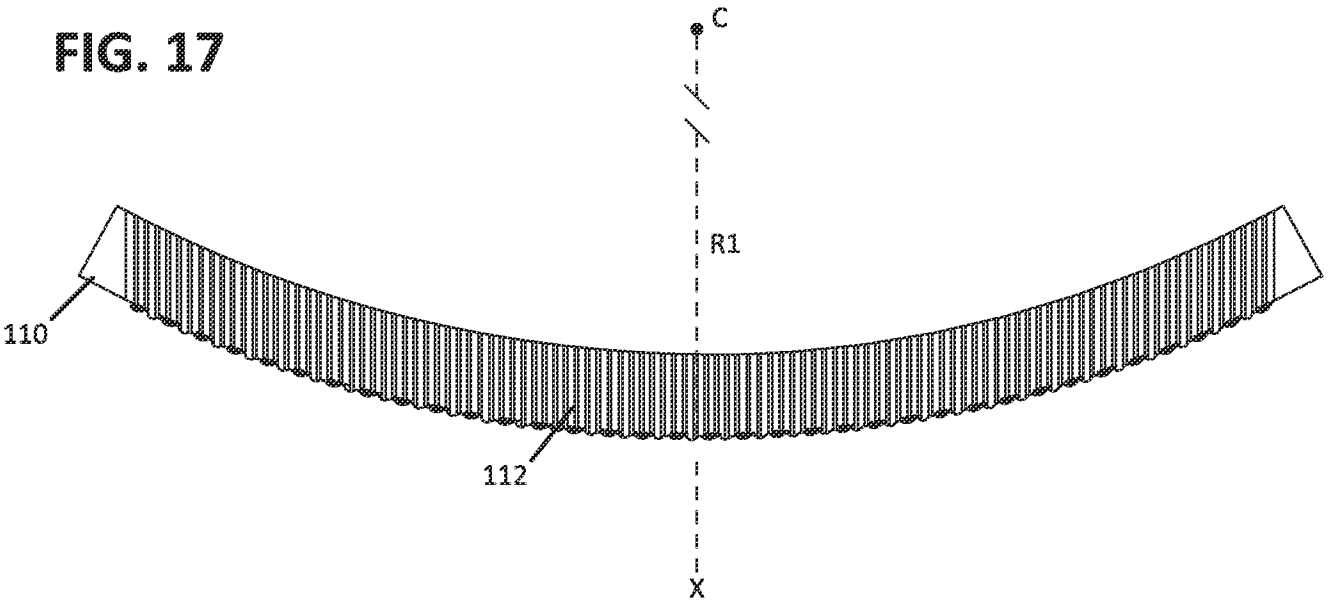
FIG. 17 is a cross-sectional top view of the heating element shown in FIG. 14.
Figure 18:
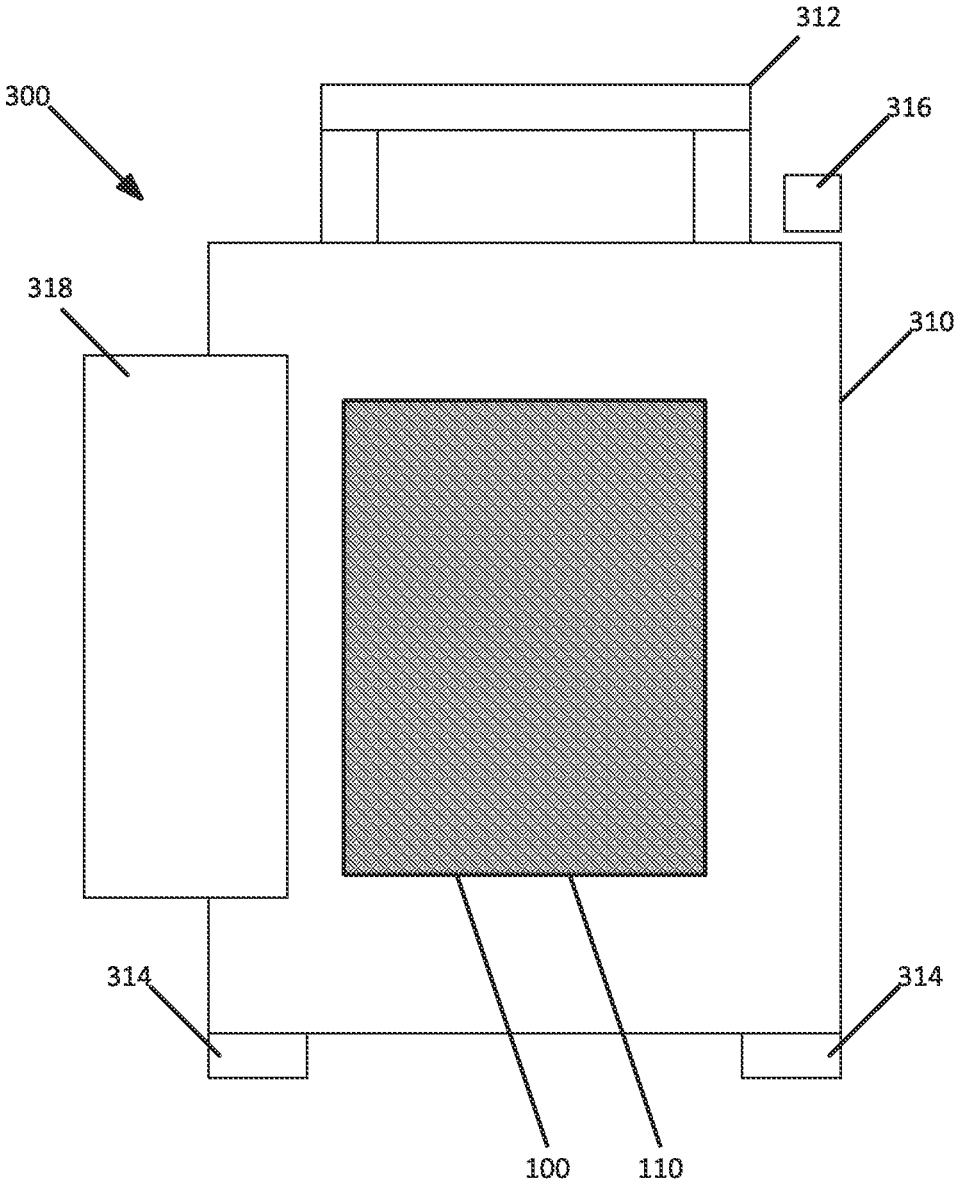
FIG. 18 is a front schematic view of a portable heater configured to incorporate the heating elements of the present disclosure.

Referring to FIG. 18, it can be seen that a burner section or assembly 100 including one or more curved plaques/heating elements 110 of the present disclosure, for example the curved plaques 110 of FIGS. 3 and 14, can be incorporated into a portable heater 300 having a housing 310, a handle 312, support feet 314, a controller 316 for directing gas to the burner assembly 100, and a fuel tank 318, such as a standard propane tank, for providing gas to the burner assembly.

From the forgoing detailed description, it will be evident that modifications and variations can be made in the aspects of the disclosure without departing from the spirit or scope of the aspects. While the best modes for carrying out the many aspects of the present teachings have been described in detail, those familiar with the art to which these teachings relate will recognize various alternative aspects for practicing the present teachings that are within the scope of the appended claims.

What is claimed is:

1. A heating element for a radiant heating system comprising:

a. a ceramic plaque forming a main body defining an inner surface and a curved outer surface, the curved outer surface having a radius about a center point passing through a longitudinal axis of the main body; and b. a plurality of pores extending through the main body between the inner surface and the outer surface, wherein a length of at least some of the plurality of pores are disposed in a parallel relationship with a length of at least some others of the plurality of pores, wherein some of the plurality of pores are disposed in a non-parallel relationship with at least some others of the plurality of pores.

2. The heating element of claim 1, wherein the entire outer surface is curved.

3. The heating element of claim 1, wherein the outer surface is curved along a constant radius.

4. The heating element of claim 1, wherein the inner surface is curved.

5. The heating element of claim 1, wherein the outer surface is curved in two directions.

6. The heating element of claim 1, wherein at least some of the plurality of pores are disposed in a non-orthogonal relationship with the outer surface.

7. A portable heater comprising:

a. a housing assembly including a housing and a handle for transporting the housing;

b. a burner located within the housing; and c. a heating element being located within the housing proximate the burner; the heating element including a ceramic plaque forming a main body defining an inner surface and a curved outer surface, the curved outer surface having a radius about a center point passing through a longitudinal axis of the main body, and a plurality of pores extending through the main body between the inner surface and the outer surface, wherein a length of at least some of the plurality of pores are disposed in a parallel relationship with a length of at least some others of the plurality of pores, wherein the pores have a diameter of about 1 millimeter.

* * * * *